US009703245B2

(12) United States Patent
Nagai

(10) Patent No.: US 9,703,245 B2
(45) Date of Patent: Jul. 11, 2017

(54) IMAGE PROCESSING APPARATUS, IMAGE PROCESSING METHOD, AND STORAGE MEDIUM PERFORMING TONER AMOUNT ADJUSTMENT

(71) Applicant: CANON KABUSHIKI KAISHA, Tokyo (JP)

(72) Inventor: Jun Nagai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/008,927

(22) Filed: Jan. 28, 2016

(65) Prior Publication Data

US 2016/0223941 A1 Aug. 4, 2016

(30) Foreign Application Priority Data

Jan. 29, 2015 (JP) ..... 2015-015293

(51) Int. Cl.
*G03G 15/00* (2006.01)

(52) U.S. Cl.
CPC . *G03G 15/5058* (2013.01); *G03G 2215/0129* (2013.01); *G03G 2215/0164* (2013.01)

(58) Field of Classification Search
None
See application file for complete search history.

(56) References Cited

U.S. PATENT DOCUMENTS

2005/0249515 A1* 11/2005 Furukawa ..... G03G 15/1625 399/53

FOREIGN PATENT DOCUMENTS

JP 2009109544 A 5/2009

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus that forms an image on a printing medium by an electrophotographic system in accordance with input image data, the apparatus including: a plurality of image forming units configured to form images in colors different from one another; a first determination unit configured to determine whether or not toner amount adjustment is necessary based on a possibility of the occurrence of a ghost for image data that is used for image formation in a second image forming unit located on the upstream side of a first image forming unit that is located on the downstream side in a conveyance direction of the printing medium of the plurality of image forming units; and a toner amount adjustment unit configured to make toner amount adjustment for the image data that is used for image formation in the second image forming unit in accordance with the determination results by the first determination unit.

14 Claims, 11 Drawing Sheets

IMAGE PROCESSING APPARATUS, IMAGE PROCESSING METHOD, AND STORAGE MEDIUM PERFORMING TONER AMOUNT ADJUSTMENT

BACKGROUND OF THE INVENTION

Field of the Invention

The present invention relates to an image processing method for suppressing the occurrence of, in particular, an image defect in an image forming apparatus of an electrophotographic system.

Description of the Related Art

In general, in an image forming apparatus of an electrophotographic system, after the surface of an image carrier (e.g., photoconductor drum) is electrified evenly by an electrifying device, a toner image is formed on the surface of the photoconductor drum. Then, the toner image that is formed on the surface of the photoconductor drum is transferred onto a printing medium, such as paper, or an intermediate image transfer body by a transfer device.

At the time of forming an image by such an electrophotographic system, there is a case where the surface potential of the photoconductor drum after transfer processing becomes uneven. In the case where the surface of the photoconductor drum whose surface potential is uneven is electrified again by the electrifying device, there is a possibility that unevenness will remain in the surface potential because it is not possible to evenly electrify the surface of the photoconductor drum. The unevenness in the surface potential such as this in the photoconductor drum may cause an image defect called a ghost to occur in an image that is formed on the photoconductor drum afterward.

As a conventional technique to eliminate the unevenness such as this in the surface potential of the photoconductor drum, there is a technique to provide an electricity eliminating device called a pre-exposure device between a transfer device and an electrifying device along the rotation direction of the photoconductor drum. According to this technique, it is possible to prevent the occurrence of an image defect by eliminating electricity from the surface of the photoconductor drum with exposure light from the pre-exposure device before electrifying the surface of the photoconductor drum by an electrifier, and thereby, shifting the surface potential to an even potential.

On the other hand, in recent years, there is a demand for an image forming apparatus that implements a low cost and downsizing. Installing the above-described pre-exposure device in the image forming apparatus increases the manufacturing cost and the apparatus size, and therefore, is incompatible with the above-described demand.

In view of this point, a technique has been proposed (see Japanese Patent Laid-Open No. 2009-109544), in which an attempt to suppress the occurrence of a ghost is made by correcting the density of image data at a downstream position, in which a ghost is expected to occur, based on a combination (correspondence relationship) of image data that is formed on the upstream side, image data that is formed on the downstream side, and an amount of correction of the image data that is formed on the downstream side in a color image forming apparatus in which no pre-exposure device is installed.

However, with the technique of Japanese Patent Laid-Open No. 2009-109544, which increases the density of the portion where a ghost occurs in the image data that is formed on the downstream side where a ghost occurs, it is difficult to perfectly match the density of the portion where a ghost occurs with the density of the portion where no ghost occurs. The reason is that in the case where the cause of the occurrence of a ghost is, for example, the fact that the image data on the upstream side is data of a complicated shape, such as character data, it is difficult to change the density of only the corresponding area portion in the image data on the downstream side because the positioning control or the like is difficult. Further, the density of the ghost occurrence portion is not perfectly even and is subject to the influence of the change with the passage of time or the environmental fluctuations even by performing correction using a test chart.

SUMMARY OF THE INVENTION

The image forming apparatus according to the present invention is an image forming apparatus that forms an image on a printing medium by an electrophotographic system in accordance with input image data, and includes a plurality of image forming units configured to form images in colors different from one another, a first determination unit configured to determine whether or not toner amount adjustment is necessary based on a possibility of the occurrence of a ghost for image data that is used for image formation in a second image forming unit located on the upstream side of a first image forming unit that is located on the downstream side in a conveyance direction of the printing medium of the plurality of image forming units, and a toner amount adjustment unit configured to make toner amount adjustment for the image data that is used for image formation in the second image forming unit in accordance with determination results by the first determination unit.

Further features of the present invention will become apparent from the following description of exemplary embodiments (with reference to the attached drawings).

DESCRIPTION OF THE EMBODIMENTS

Hereinafter, with reference to the attached drawings, the present invention is explained in detail in accordance with preferred embodiments. Configurations shown in the following embodiments are merely exemplary and the present invention is not limited to the configurations shown schematically.

First Embodiment

As the present embodiment, the case where the present invention is applied to a multi function printer (MFP) whose developers (toner) are in four colors of CMYK is explained as an example. However, the present invention is not limited to the aspects described below and it is possible to widely apply the present invention to a color image forming apparatus of an electrophotographic system within the scope not deviating from its gist.

Figure 1:
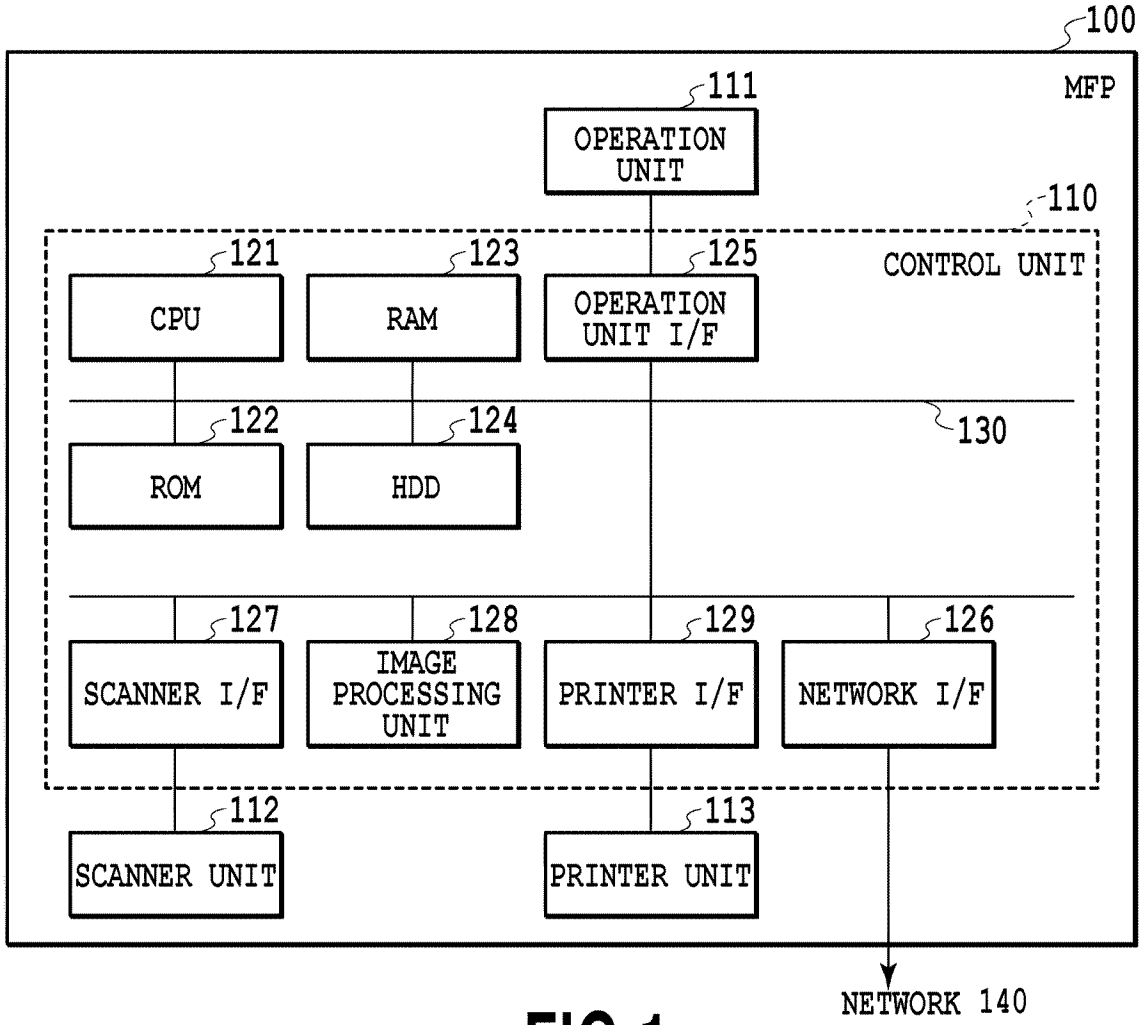
FIG. 1 is a block diagram showing a basic configuration of an MFP.

FIG. 1 is a block diagram showing a basic configuration of an MFP according to the present embodiment. An MFP 100 includes a control unit 100, an operation unit 111, a scanner unit 112, and a printer unit 113.

The operation unit 111 includes a liquid crystal panel or the like having a touch screen function and displays various kinds of information (e.g., the setting state of the apparatus, the current processing inside the apparatus, the error state, etc.) to a user and receives instructions to perform a scan or the like, and specified printing conditions, such as enlargement, reduction, and rotation, via a UI screen.

The scanner unit 112 has a function to acquire image data by scanning a document that is set on a document table or an ADF.

The printer unit 113 (printer engine) has a function to form an image by an electrophotographic system on a printing medium, such as paper, by using image data that is received from the control unit 110.

The control unit 110 is connected to a network 140 as well as being electrically connected to each unit described above. The control unit 110 includes a CPU 121, a ROM 122, a RAM 123, an HDD 124, an operation unit I/F 125, a network I/F 126, a scanner I/F 127, an image processing unit 128, a printer I/F 129, and an internal bus 130.

The CPU 121 is a processor that totally controls the MFP 100 and controls each unit that is connected via the internal bus 130 based on various programs or the like stored in the ROM 122.

The ROM 122 is a storage area of system start programs, programs for controlling the printer engine, and various programs and data, such as character data and character code information.

The RAM 123 is a system work memory for the CPU 121 to operate and is also a memory for temporarily storing image data. In the RAM 123, font data that is registered additionally by download is stored and programs and data are loaded for each piece of various kinds of processing.

The HDD 124 is a hard disk drive as a large-capacity storage area and is utilized to spool data and to store programs, each information file, and image data.

The operation unit I/F 125 is an interface that connects the internal bus 130 and the operation unit 111 and serves as an intermediary of outputting of data of an image that is displayed on the operation unit 111 to the operation unit 111 and of inputting of user's instructions or the like that are input from the operation unit 111.

The network I/F 126 is an interface that connects the internal bus 130 and the network 140 and performs transmission and reception of various kinds of data with other devices that are connected via the network 140. For example, the network I/F 126 receives image data and drawing data from a host computer, not shown.

The scanner I/F 127 is an interface that connects the internal bus 130 and the scanner unit 112 and also performs correction, processing, editing, etc., for scanned image data that is received from the scanner unit 112.

The image processing unit 128 performs various kinds of image processing, to be described later.

The printer I/F 129 is an interface that connects the internal bus 130 and the printer unit 113 and inputs and outputs commands or the like for controlling the printer engine.

Although not shown schematically, it may also be possible to separately provide an external interface for connecting with an external device, such as a digital camera.

<About Image Processing Unit>

Figure 2:
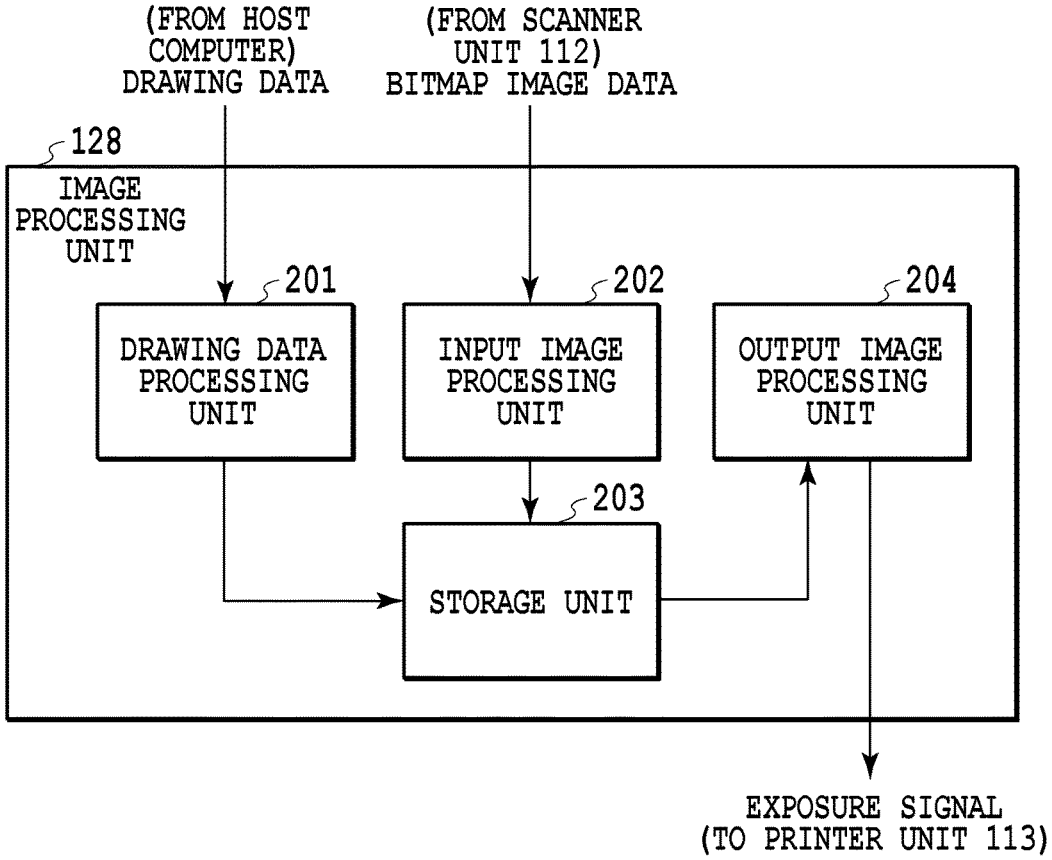
FIG. 2 is a block diagram showing an internal configuration of an image processing unit.

Subsequently, the image processing unit 128 is explained in detail. FIG. 2 is a block diagram showing an internal configuration of the image processing unit 128. Each function unit constituting the image processing unit 128 may be implemented by, for example, the CPU 121 executing predetermined programs stored in the ROM 122 or part or all of the function units may be implemented by a dedicated IC.

First, the function of the image processing unit 128 is explained by taking the case where printing processing is performed by receiving drawing data, also called a print job generally, from a host computer (not shown) as an example.

First, it is assumed that in a host computer, digital documents, such as page layout documents, word processor documents, and graphic documents, are created by an application and drawing data of the document data is generated by a printer driver within the host computer. The digital document data that is handled by the printer driver is not limited to that created by the host computer, but the digital document data may be created by an application or the like of another computer and saved in an HDD or the like of the host computer.

In general, the drawing data that is generated is data described in a PDL (Page Description Language) (hereinafter, PDL data). Normally, the drawing data includes printing settings relating to the printing resolution, number of copies to be printed, page layout, printing order, etc., as control commands along with drawing commands of objects, such as images, graphics, and text. The drawing data that is generated by the printer driver is transmitted to the MFP 100 via the network 140 and is delivered to the image processing unit 128.

The image processing unit 128 generates image data in a format that can be processed by the printer unit 113 based on the drawing data that is received from the host computer. The generated image data in the predetermined format is sent to the printer unit 113. The printer unit 113 forms an image on a printing medium, such as paper, by a printer engine, to be described later, in accordance with the received image data in the predetermined format. The image processing unit 128 includes a drawing data processing unit 201, an input image processing unit 202, a storage unit 203, and an output image processing unit 204.

The drawing data processing unit 201 generates a drawing object by performing analysis processing on the PDL data within the drawing data and generates bitmap image data by further performing rasterize processing. At this time, the drawing data processing unit 201 also extracts the control commands relating to the printing settings, for example, the layout or the like, which are included within the drawing data. These bitmap image data and control commands are stored in the storage unit 203. The storage unit 203 consists of part of the RAM 123 or the HDD 124.

The output image processing unit 204 reads the bitmap image data and the printing settings from the storage unit 203 and converts the bitmap image data into image data in a format that can be processed by the printer unit 113 by performing editing processing in accordance with the printing settings, color conversion processing into a printer-dependent color space of CMYK or the like, and image processing, such as halftone processing. Further, the output image processing unit 204 also performs image processing for suppressing a ghost, which will be described later.

The image data that is generated by the image processing unit 128 in this manner is sent to the printer unit 113 via the printer I/F 129. The printer unit 113 performs printing and outputting on, for example, paper, which is a transfer material, by performing each piece of processing of exposure, development, transfer, and fixing based on the received image data.

By the processing as described above, the printing processing based on the drawing data from the host computer is completed.

Next, the function of the image processing unit 128 is explained by taking the case where the printing processing is performed based on the bitmap image data that is input from the scanner unit 112 as an example.

The scanner unit 112 is connected to the image processing unit 128 via the scanner I/F 127 and the internal bus 130. The scanner unit 112 generates bitmap image data by optically scanning an image that is printed on paper or a film, measuring the intensity of reflected light and transmitted light, and carrying out analog-to-digital conversion. In general, the bitmap image data is image data in the RGB color space. The bitmap image data that is input from the scanner unit 112 is sent to the input image processing unit 202.

The input image processing unit 202 performs image processing, such as shading correction processing, color conversion processing into a common color space, such as sRGB, and filter processing, on the bitmap image data that is input from the scanner unit 112 or the like. The bitmap image data on which the image processing such as this has been performed is stored in the storage unit 203. After that, by performing the above-described halftone processing or the like on the bitmap image data in the output image processing unit 204, the bitmap image data is converted into image data in a format that can be processed by the printer unit 113. The image data thus generated is sent to the printer unit 113 and the above-described printing and outputting are performed. The bitmap image data that is input to the input image processing unit 202 may be bitmap image data as a photographed image that is acquired by changing the intensity of light into an electrical signal by a CCD in which photodiodes are arranged side by side in, for example, a digital camera that is an external device. In the case where bitmap image data or image data that has been JPEG-compressed is received from the host computer, in place of the drawing data, the image data is input to the input image processing unit 202 as a result.

By the processing described above, the printing processing based on the bitmap image data that is input from the scanner unit 112 or the like is completed.

<About Printer Engine>

Figure 3:
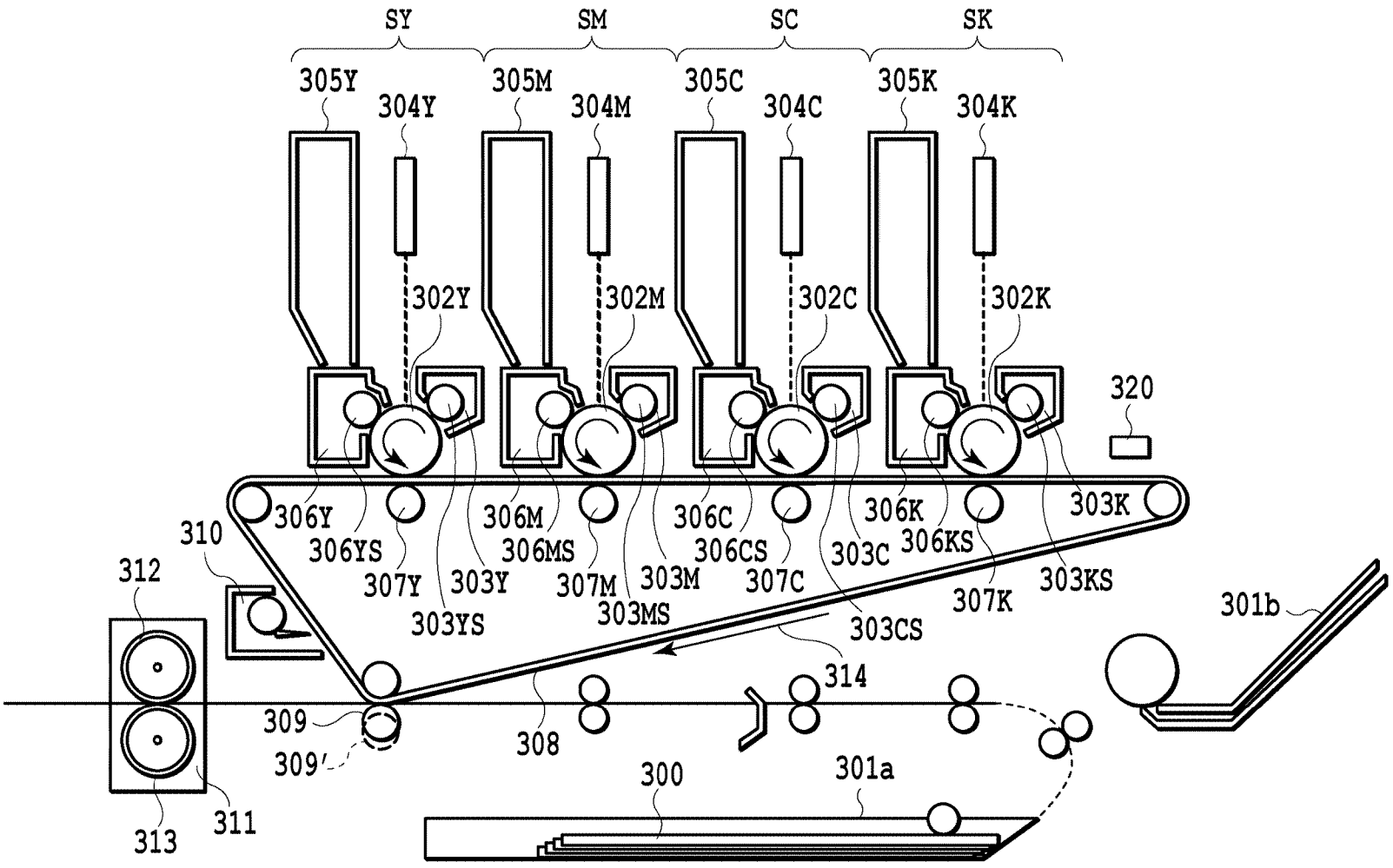
FIG. 3 is a diagram showing a configuration of a printer engine of a four-color tandem system.

Subsequently, the printer engine, which is an important component of the printer unit 113, is explained. FIG. 3 is a diagram showing a configuration of a printer engine of a four-color tandem system according to the present embodiment.

The printer engine forms an electrostatic latent image by driving a light source of an exposure unit in accordance with an exposure signal that is output from the output image processing unit 204 described previously, and forms a single color toner image (developer image) by developing the electrostatic latent image. Then, the printer engine forms a multicolored toner image by superimposing the single color toner images and fixes the multicolored toner image on a printing medium 300 after transferring the multicolored toner image onto the printing medium 300.

The printer engine shown in FIG. 3 includes four image forming units SY, SM, SC, and SK each for forming a toner image by using toner in each color of yellow (Y), magenta (M), cyan (C), and black (K). In the following, it is assumed that the image forming units SY, SM, SC, and SK are called a first station, a second station, a third station, and a fourth station, respectively.

Each station is arranged in the order from the first station to the fourth station along a circumferential surface of an intermediate image transfer body 308 from the upstream side toward the downstream side in the moving direction of the circumferential surface (see an arrow 314). The image forming operation is performed in the order of electrification, exposure, development, transfer, and fixing. Hereinafter, each operation is explained.

(Electrification)

First, photoconductor drums 302Y, 302M, 302C, and 302K are electrified by electrifying devices 303Y, 303M, 303C, and 303K, respectively. The electrifying devices are provided with sleeves 303YS, 303MS, 303CS, and 303KS, respectively. Each photoconductor drum has a configuration in which to the outer circumference of an aluminum cylinder, an organic photoconductive layer is applied and a drive force of a drive motor (not shown) is transmitted, enabling the photoconductor drum to rotate. The drive motor rotates each photoconductor drum in the counterclockwise direction in accordance with the image forming operation.

(Exposure)

Next, the surface of each photoconductor drum is selectively exposed by irradiating each of the photoconductor drums 302Y, 302M, 302C, and 302K with light from each of light sources 304Y, 304M, 304C, and 304K, and thereby, an electrostatic latent image is formed.

(Development)

Subsequently, the electrostatic latent image is visualized by each of developing devices 306Y, 306M, 306C, and 306K, i.e., a single color toner image is formed on each photoconductor drum. The developing devices are provided with sleeves 306YS, 306MS, 306CS, and 306KS, respectively. Each developing device can be attached and detached.

(Transfer)

Then, by the rotation, which is caused by rotating the intermediate image transfer body 308 in the clockwise direction, of the respective photoconductor drums 302Y, 302M, 302C, and 302K and respective primary transfer rollers 307Y, 307M, 307C, and 307K located in opposition thereto, the single color toner image is transferred onto the intermediate image transfer body 308. By applying an appropriate bias voltage to each primary transfer roller and at the same time, by making the rotation speed of each photoconductor drum differ from the rotation speed of the intermediate image transfer body 308, it is possible to transfer the single color toner image onto the intermediate image transfer body 308 with efficiency (primary transfer).

A yellow toner image that is formed on the photoconductor drum 302 of the first station is transferred onto the intermediate image transfer body 308 by the rotation of the photoconductor drum 307Y. The yellow toner image that is transferred onto the intermediate image transfer body 308 is conveyed by the movement of the circumferential surface of the intermediate image transfer body 308. Then, in synchronization with the movement of the yellow toner image on the intermediate image transfer body 308, each of magenta, cyan, and black toner images that are formed in the second to fourth stations is transferred by being superimposed on the yellow toner image from each of the photoconductor drums 302M, 302C, and 302K. Due to this, a multicolored toner image in four colors is formed on the surface of the intermediate image transfer body 308. The multicolored toner image is conveyed up to a secondary transfer roller 309 by the rotation of the intermediate image transfer body 308. Then, the printing medium 300 is pinched and conveyed from paper feed trays 301*a*/301*b* to the secondary transfer roller 309 and the multicolored toner image on the intermediate image transfer body 308 is transferred onto the printing medium 300. At this time, an appropriate bias voltage is applied to the secondary transfer roller 309 and the toner image is transferred electrostatically (secondary transfer). The secondary transfer roller 309 remains in contact with the printing medium 300 at the position of the secondary transfer roller 309 while the multicolored toner image is being transferred onto the printing medium 300 and after the processing, the secondary transfer roller 309 moves apart from the contact position to a position indicated by 309'.

(Fixing)

Then, the multicolored toner image that is transferred onto the printing medium 300 is fused and fixed on the printing medium 300. For this purpose, a fixing roller 312 that applies heat to the printing medium 300 and a pressure roller 313 that causes the printing medium 300 to come into contact with the fixing roller 312 under pressure are provided. The fixing roller 312 and the pressure roller 313 are formed into a hollow shape and inside thereof, a heater is incorporated, respectively. A fixing device 311 conveys the printing medium 300 holding the multicolored toner image by means of the fixing roller 312 and the pressure roller 313 and at the same time, applies heat and pressure to fix toner to the printing medium 300. The printing medium 300 after toner is fixed is discharged to a discharge tray (not shown) by a discharge roller (not shown).

In this manner, the series of image forming operations is completed.

After the image forming operation is completed, the toner that is left on the intermediate image transfer body 308 is removed by a cleaning unit 310. The unused toner that is left after the multicolored toner image that is formed on the intermediate image transfer body 308 is transferred onto the printing medium 300 is stored in a cleaner container.

<About Output Image Processing Unit>

Next, details of the output image processing unit 204 are explained.

Figure 4:
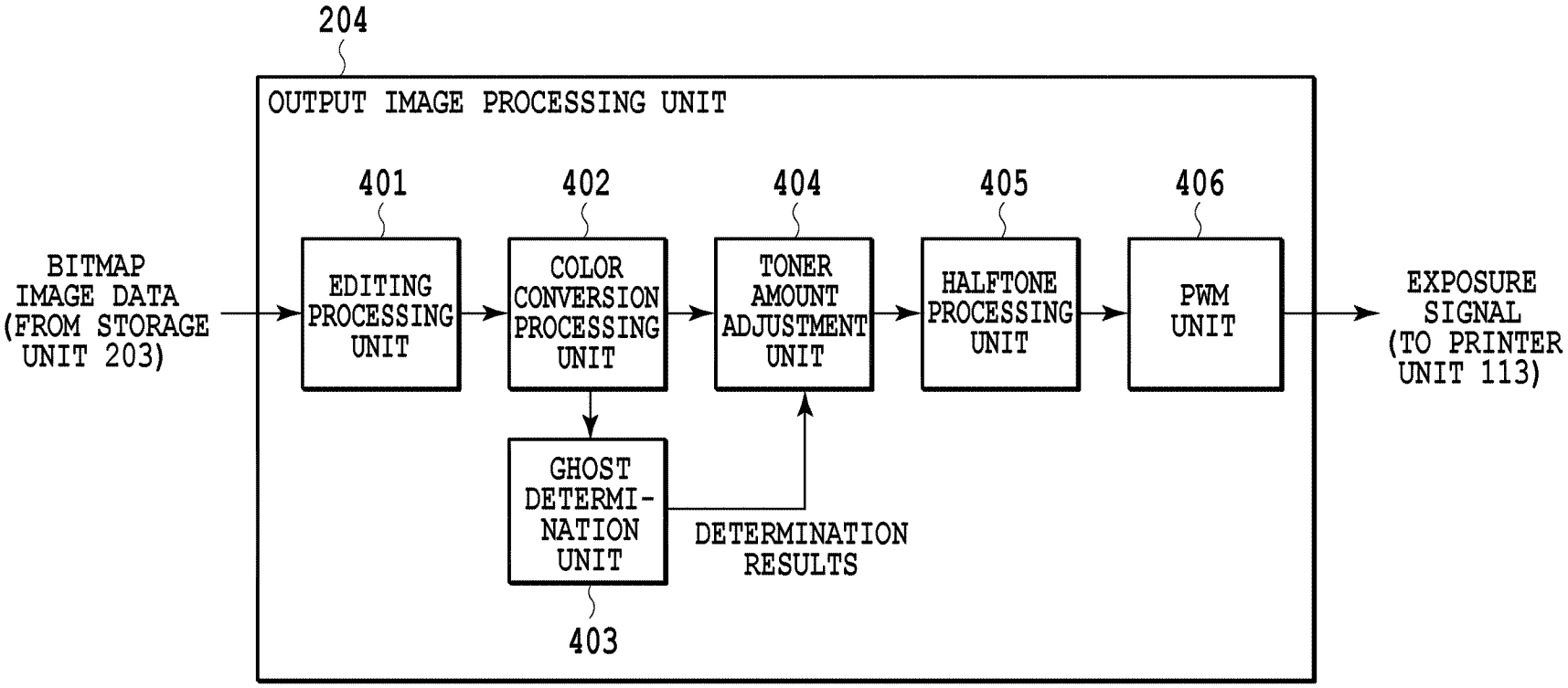
FIG. 4 is a block diagram showing an internal configuration of an output image processing unit.

FIG. 4 is a block diagram showing the internal configuration of the output image processing unit 204. As shown in FIG. 4, the output image processing unit 204 includes an editing processing unit 401, a color conversion processing unit 402, a ghost determination unit 403, a toner amount adjustment unit 404, a halftone processing unit 405, and a PWM unit 406.

The editing processing unit 401 performs editing processing, such as layout processing and rotation processing, in accordance with printing settings on bitmap image data that is read from the storage unit 203.

The color conversion processing unit 402 performs color conversion processing to convert image data in the RGB color space on which the editing processing has been performed by the editing processing unit 401 into image data in the CMYK color space corresponding to toner in four colors of CMYK that can be processed by the printer engine.

The ghost determination unit 403 analyzes the CMYK image data on which the color conversion processing has been performed and determines whether or not the image data is data in which a ghost occurs. Details of the determination processing will be described later.

The toner amount adjustment unit 404 performs processing to adjust the toner amount on the CMYK image data in accordance with the determination results by the ghost determination unit 403. Details of the toner amount adjustment processing will be described later.

The halftone processing unit 405 generates halftone image data in accordance with the number of tone levels that can be represented by the printer unit 113 by performing halftone processing on the CMYK image data on which the toner amount adjustment processing has been performed. In many cases, a printer engine is normally capable of producing an output in a small number of tone levels, such as 2 tone levels, 4 tone level, and 16 tone levels. Because of this, halftone processing by using a method, such as the error diffusion method and the dither method, is performed so that the printer unit 113 capable of producing an output only in such a small number of tone levels can stably represent a halftone.

The PWM unit 406 generates a signal (exposure signal) representing an exposure time that can be input to the light source 304 of the printer engine by performing pulse width modulation (PWM) based on the halftone image data that is generated by the halftone processing.

<About Ghost Determination Unit>

Figure 5A:
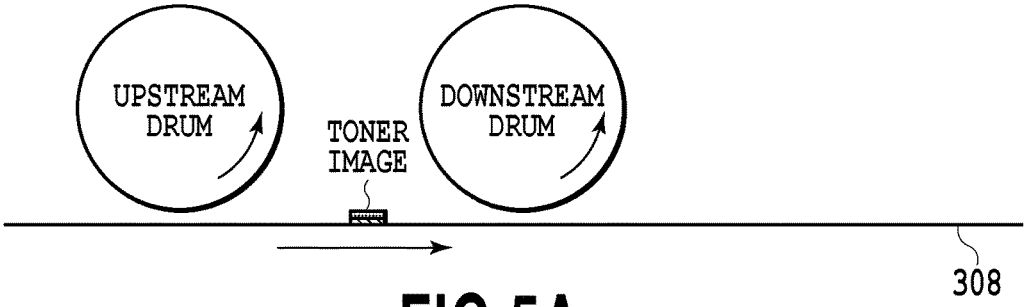
FIGS. 5A to 5C are diagrams explaining a mechanism of the occurrence of a ghost.
Figure 5B:
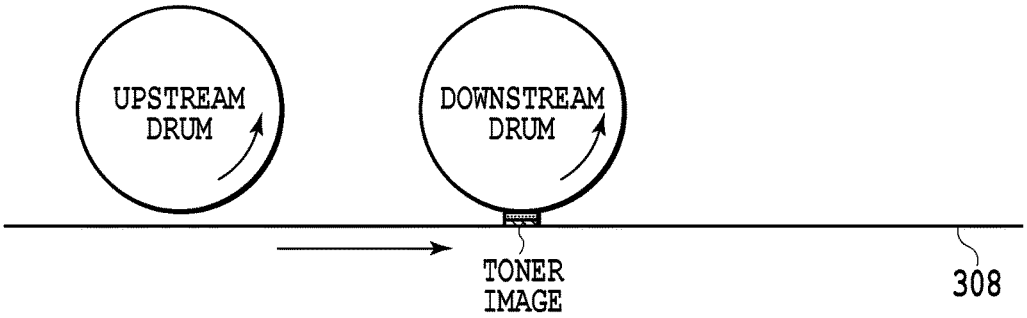
Figure 5C:
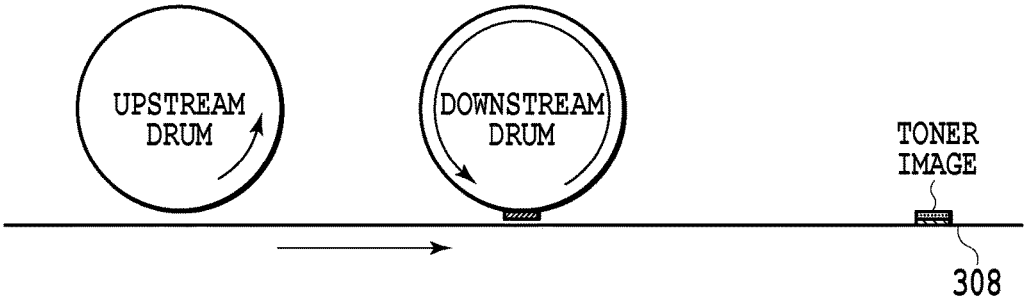
Figure 6B:
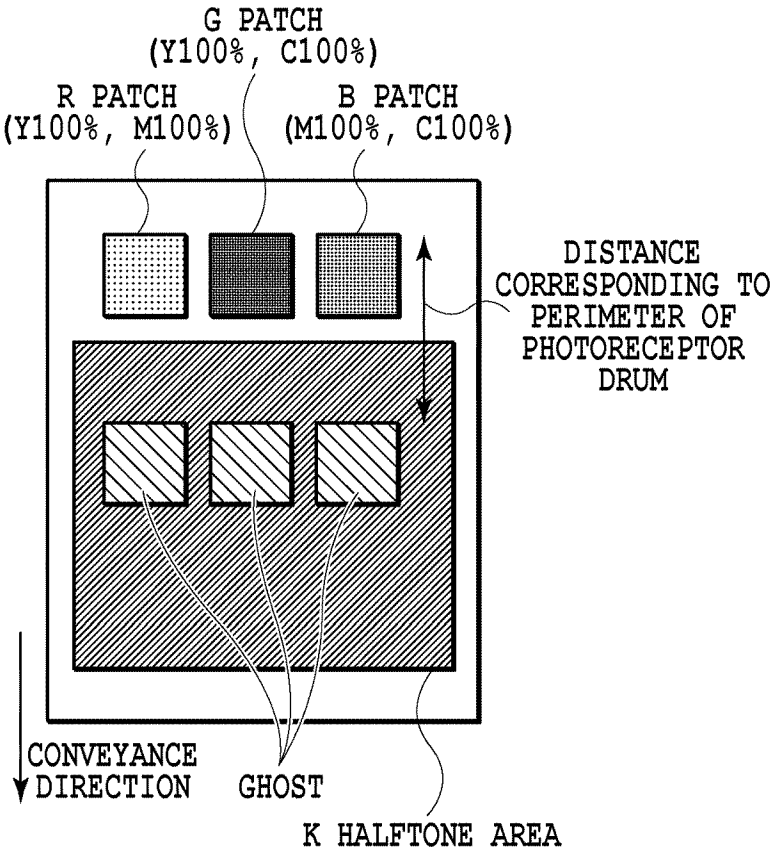
FIGS. 6A and 6B are diagrams each showing the way a ghost has occurred.
Figure 6A:
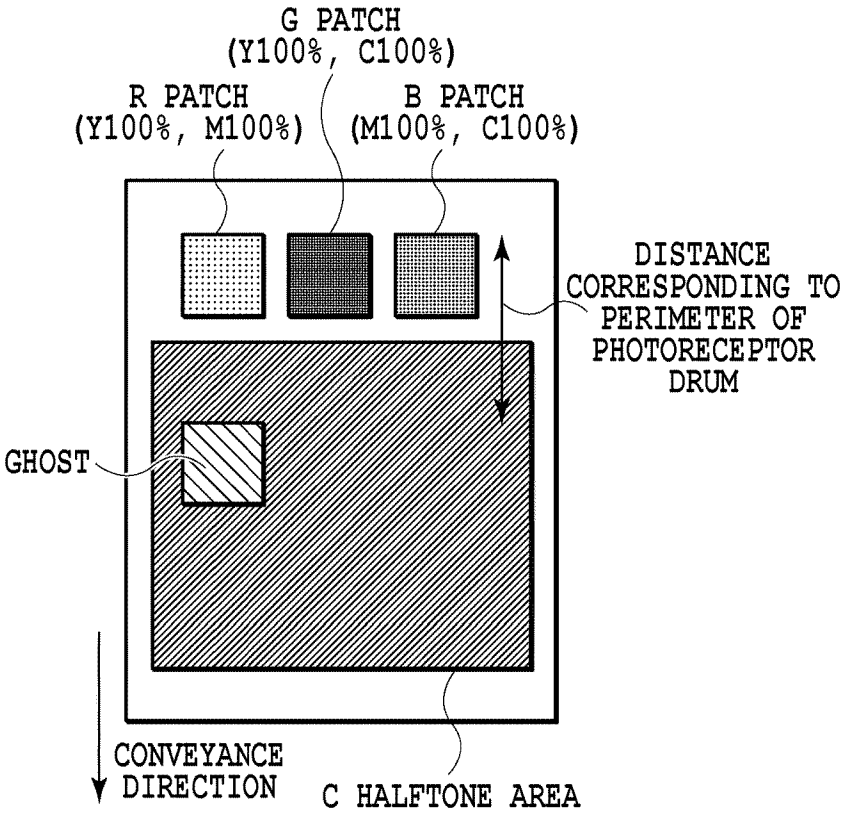

First, the cause of the occurrence of a ghost is explained. FIGS. 5A to 5C are diagrams explaining a mechanism of the occurrence of a ghost. In FIGS. 5A to 5C, the way a toner image that has been developed in the upstream station is transferred onto the intermediate image transfer body 308 and conveyed in the direction of an arrow is shown with the passage of time in the order of FIGS. 5A, 5B, and 5C. FIG. 5A shows the way the toner images that have been formed in the upstream stations are sequentially superimposed and transferred onto the intermediate image transfer body 308 that is driven circularly. FIG. 5B shows the state where the toner images transferred in the upstream stations have reached the primary transfer roller unit of the downstream station. At this time, by the influence of the toner images that have been formed in the upstream stations, a primary transfer current becomes uneven. Because of this, in the case where electrification by the electrifying device is performed in the next image forming process, the surface potential of the photoconductor drum becomes uneven. As a result of this, in the downstream station, the density seems to be decreased relatively for the portion corresponding to the image in the upstream station before one rotation is made. FIGS. 6A and 6B are diagrams showing the way a ghost has occurred. In FIG. 6A, three kinds of patches (R patch, G patch, B patch) are formed above a cyan halftone area. This case shows a state where a ghost corresponding to the R patch has occurred at the position (downstream position in the conveyance direction) a distance corresponding to the perimeter of the photoconductor drum apart in the downward direction from the position of the R patch (in yellow and magenta) that is formed by the first and second stations located on the upstream side of the third station of cyan. In FIG. 6B, the three kinds of patches (R patch, G patch, B patch) are similarly formed above a black halftone area. FIG. 6B shows a state where a ghost corresponding to each patch has occurred at each position a distance corresponding to the perimeter of the photoconductor drum apart in the downward direction from each of the positions of the R patch (in yellow and magenta), the G patch (in yellow and cyan), and the B patch (in magenta and cyan) that are formed by the first to third stations located on the upstream side of the fourth station of black. In the manner as described above, the phenomenon called a ghost occurs.

Figure 7A:
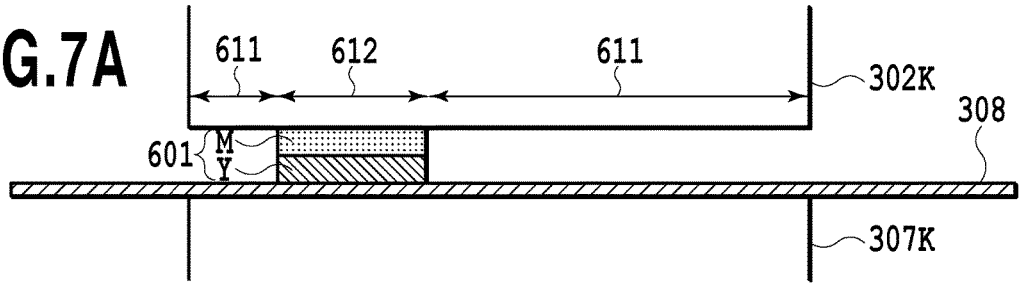
FIG. 7A is section view in a main scanning direction in the case where no image is formed on a photoconductor drum of a fourth station and FIGS. 7B to 7D are diagrams each showing the way the surface potential in the main scanning direction changes.
Figure 7B:
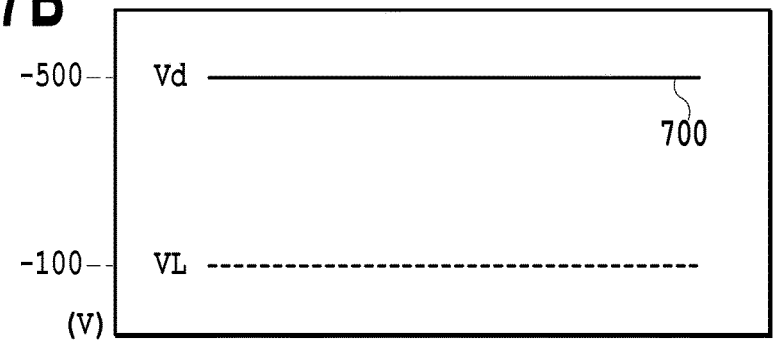
Figure 7C:
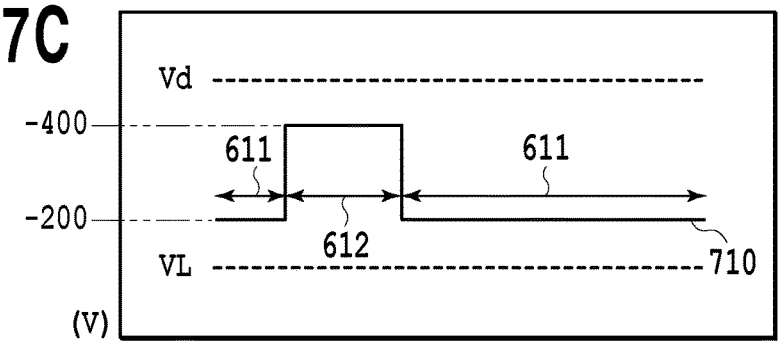
Figure 7D:
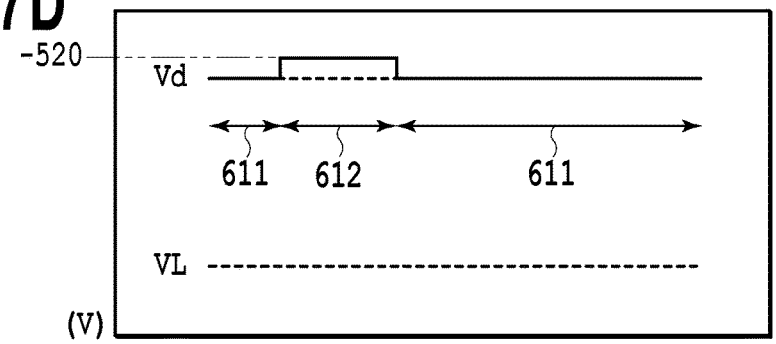

Next, the change in the surface potential of the photoconductor of the downstream station is explained. FIG. 7A is a section view in the main scanning direction in the case where no image is formed on the photoconductor drum 302K of the fourth station SK in FIG. 3. Then, FIGS. 7B to 7D are diagrams each showing the way the surface potential in the main scanning direction changes in this case. In FIGS. 7B to 7D, Vd indicates a dark part potential (here, −500 V) and VL indicates a bright part potential (here, −100 V), respectively, and a solid line indicates the current surface potential.

Here, FIG. 7A shows a state where a toner image 601 in a secondary color, which is a combination of yellow and magenta, formed on the intermediate image transfer body 308 in the first and second stations, respectively, has reached the primary transfer roller 307K of the fourth station SK. At the position of the primary transfer roller 307K, in a surface area 611 of the photoconductor drum 302K, a primary transfer bias is applied from the primary transfer roller 307K side via only the intermediate image transfer body 308. On the other hand, in a surface area 612 of the photoconductor drum 302K, the primary transfer bias is applied from the primary transfer roller 307K side via the toner image 601 in the secondary color and the intermediate image transfer body 308.

FIGS. 7B and 7C each show the surface potential at the portion with which the toner image 601 comes into contact on the photoconductor drum 302K in the case where the toner image 601 that is formed on the intermediate image transfer body 308 passes the primary transfer roller 307K section, and FIG. 7B shows the surface potential before the passing and FIG. 7C shows the surface potential after the passing. Before the toner image 601 passes the primary transfer roller 307K section, the surface of the photoconductor drum 302K is electrified evenly (FIG. 7B), and therefore, the surface potential is even at the dark part potential Vd (e.g., about −500 V). However, while the toner image 601 is passing the primary transfer roller 307K section, in the surface area 611, the primary transfer bias is applied via only the intermediate image transfer body 308. Due to this, the surface potential in the surface area 611 shifts up to about −200 V (FIG. 7C). On the other hand, in the surface area 612, the toner image 601 serves as an impedance component, and therefore, the amount of the primary transfer current that flows into the photoconductor drum 302K from the primary transfer roller 307K side becomes smaller compared to that in the surface area 611. Further, the toner image 601 consists of toner images in two colors of yellow and magenta, and therefore, compared to the case of a single color toner image, the toner amount in the surface area 612 becomes larger and the impedance due to the toner image also becomes higher. As a result of this, compared to the case where a single color toner image is formed on the intermediate image transfer body 308, the amount of the primary transfer current that flows into the photoconductor drum 302K side becomes smaller, and therefore, the surface potential in the surface area 612 becomes about −400 V (FIG. 7C).

Figure 8A:
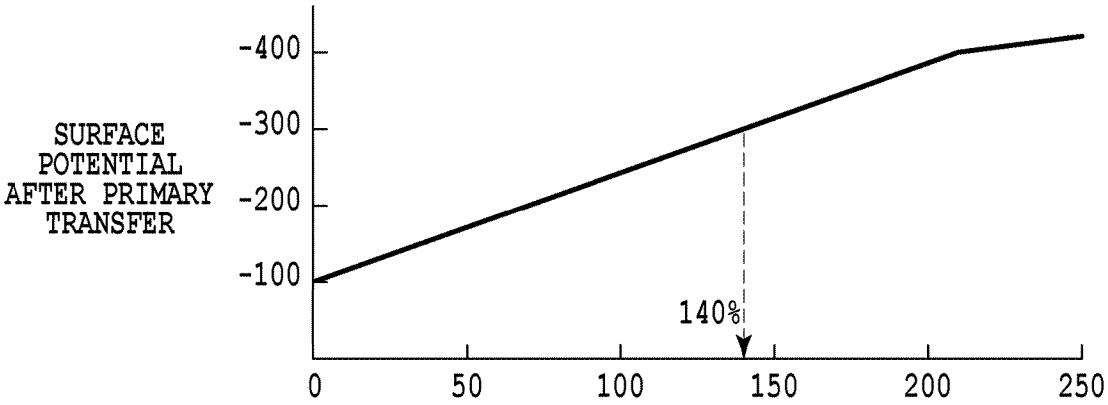
FIG. 8A is a graph representing a relationship between image data corresponding to a toner image that is formed in an upstream station and the surface potential of a photoconductor drum of a downstream station after the toner image has passed a primary transfer roller unit of the downstream station.

FIG. 8A is a graph representing a relationship between image data corresponding to a toner image that is formed in an upstream station and the surface potential of the photoconductor drum of a downstream station after the toner image passes the primary transfer roller unit of the downstream station. In the following, image data corresponding to a toner image that is formed in an upstream station is referred to as "upstream toner image data" and image data corresponding to a toner image that is formed in a station located on the downstream side of the upstream station is referred to as "downstream toner image data". In the downstream station, the surface potential of the photoconductor drum is electrified to Vd (here, −500 V) in advance and a predetermined primary transfer bias is applied. The case where the value of the horizontal axis in the graph in FIG. 8A exceeds 100% means that a toner image in two or more colors is formed on the intermediate image transfer body 308 by a plurality of stations. Then, a toner image that is formed in the upstream station serves as an impedance component in the downstream station. Due to this, a state is brought about where it is hard for the primary transfer current to flow to the surface of the photoconductor drum and the surface potential of the photoconductor drum enters the saturated state.

Figure 8B:
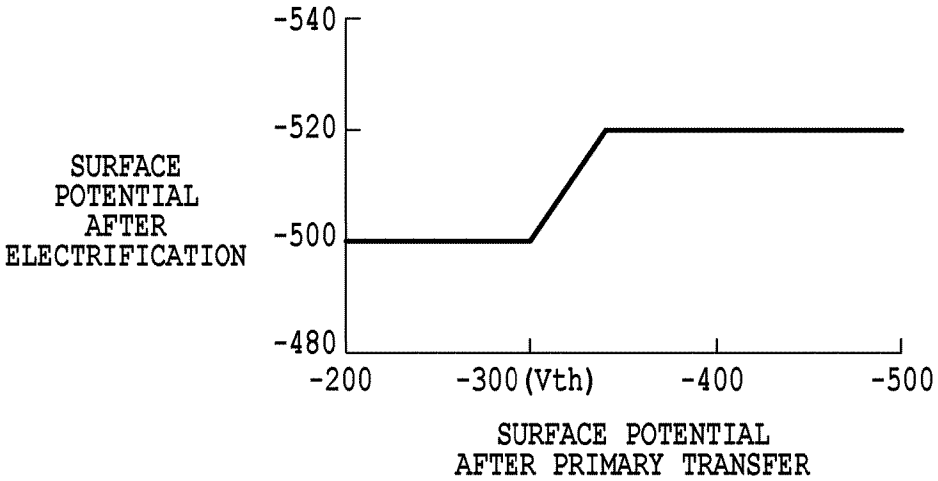
FIG. 8B is a graph representing an example of a relationship between the surface potential of the photoconductor drum after the primary transfer of the toner image onto an intermediate image transfer body and the surface potential in the case where the photoconductor drum is electrified again by an electrifier.

FIG. 8B is a graph representing an example of a relationship between the surface potential of the photoconductor drum after the primary transfer of a toner image onto the intermediate image transfer body 308 and the surface potential in the case where the photoconductor drum is electrified again by an electrifier. In the graph in FIG. 8B, the horizontal axis represents the surface potential of the photoconductor drum after the primary transfer and the vertical axis represents the surface potential in the case where the photoconductor drum is electrified again by an electrifier. As is obvious from this graph, in the case where the surface potential of the photoconductor drum after the primary transfer is equal to or less than Vth (here, −300 V) in the absolute value, the surface potential of the photoconductor drum becomes Vd (−500 V) by electrification by an electrifier. In contrast to this, in the case where the surface potential of the photoconductor drum after the primary transfer exceeds Vth in the absolute value, the surface potential of the photoconductor drum becomes a potential higher than Vd (e.g., about −520 V) in the absolute value by electrification by an electrifier. In this case, as shown in FIG. 7D, in the surface area 612 where the surface potential of the photoconductor drum after the primary transfer exceeds Vth (−300 V) in the absolute value, the surface potential of the photoconductor drum after electrification by an electrifier changes to a value (−520 V) exceeding Vd in the absolute value. As described above, depending on the surface potential of the photoconductor drum after the primary transfer, a surface potential difference of about 20 V occurs between the surface potential after electrification in the surface area 612 and the surface potential after electrification in the surface area 611, and this difference causes the occurrence of a ghost.

The ghost determination unit 403 determines whether the upstream toner image data affects the downstream toner image data based on the cause of the occurrence of a ghost as described above. In other words, in the case where an image is formed in the downstream station, whether an image that makes uneven the surface potential of the photoconductor drum of the downstream station thereof is formed in the upstream station is determined. In the case where such image data exists on the upstream side in the conveyance direction of a sheet, the toner amount adjustment unit 404 performs processing to reduce the toner amount in the upstream toner image data. The situation where the surface potential of the photoconductor drum of the downstream station is made uneven is the case where the surface potential of the photoconductor drum after the primary transfer exceeds Vth (in the present embodiment, −300 V) in the absolute value as described above. In other words, in the case of the present embodiment where Vth is set to −300 V, the surface potential after the primary transfer exceeds the absolute value Vth at the time at which the toner amount of the upstream toner image data is 140% or more (see FIG. 8A). In view of this, the processing to determine the presence/absence of the occurrence of a ghost is performed in the present embodiment.

The value of the upstream toner image data by which the surface potential after the primary transfer exceeds the absolute value Vth and which makes uneven the surface potential of the photoconductor drum of the downstream station also after electrification due to the image formation in the upstream station differs depending on the characteristics of the printer engine. Consequently, it is needless to say that the above-described value "140%" also changes depending on the printer engine. Further, it may also be possible to provide criteria to determine the presence/absence of the occurrence of a ghost in, for example, two steps, and to perform control to change the criterion to the stricter determination criterion (e.g., 140%) in the case where it is not possible to suppress the occurrence of a ghost with the looser determination criterion (e.g., 180%). However, limiting the maximum toner amount in order to suppress a ghost causes a deterioration in image quality, and therefore, it is desirable to set an appropriate determination criterion while taking into consideration the tradeoff thereof.

<Ghost Determination Processing>

Figure 9:
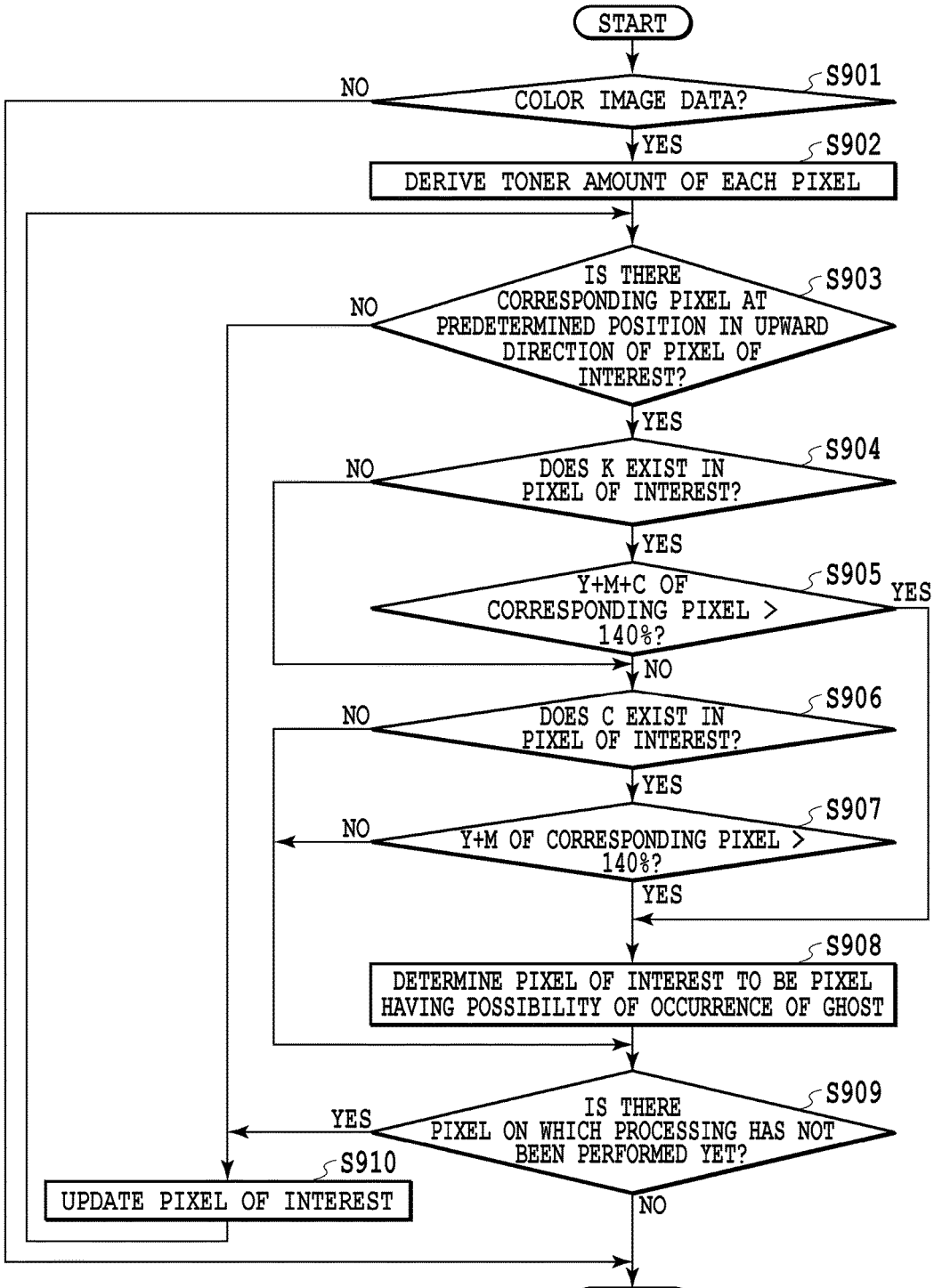
FIG. 9 is a flowchart showing a flow of ghost determination processing.

Next, details of the ghost determination processing in the ghost determination unit 403 are explained. FIG. 9 is a flowchart showing a flow of the ghost determination processing.

At step 901, the ghost determination unit 403 determines whether or not the image data to be printed is color image data. As described above, the ghost is the phenomenon unique to the case where toner images are formed sequentially in a plurality of stations, and therefore, no ghost occurs in the case of monochrome image data that uses only one (K) station. Because of this, at this step, monochrome image data not having a possibility of the occurrence of a ghost in principle is excluded from the target of the subsequent detailed discussion. In the case where the results of the determination indicate that the image data to be printed is color image data, the processing proceeds to step 902 and then, detailed discussion is carried out. On the other hand, in the case where the image data to be printed is monochrome image data, the present processing is exited.

At step 902, the ghost determination unit 403 derives the toner amount (total sum of CMYK values) for each pixel of the image data to be printed. Here, in the case where the CMYK values are represented by 8 bits, the value on a condition that nothing is printed is "0" and the value on a condition that the maximum density is output is "255". There is a case where the range "0 to 255" of the CMYK values that are represented by 8 bits is represented in terms of percentage corresponding to "0% to 100%". For example, in the case of a pixel having the maximum density in two colors of yellow and magenta, the toner amount (total sum of CMYK values) is denoted as "510 (=255+255)" or "200%".

At step 903, the ghost determination unit 403 determines whether there exists a pixel at a predetermined position in the upward direction of the pixel of interest on the image data. Here, the predetermined position in the upward direction is a position a distance corresponding to the perimeter of the photoconductor drum apart from the pixel of interest in the direction in which development is performed earlier (upstream side in the conveyance direction) (see FIGS. 6A and 6B described previously), and therefore, varies depending on the diameter of the photoconductor drum. In the case where there exists a pixel at the predetermined position in the upward direction of the pixel of interest (hereinafter, pixel located at the predetermined position is referred to as "corresponding pixel"), the processing proceeds to step 904. On the other hand, in the case where there exists no pixel at the predetermined position in the upward direction of the pixel of interest, the processing proceeds to step 910, and the pixel of interest is updated to the next pixel and this step is repeated.

At step 904, the ghost determination unit 403 determines whether or not the color for which an image is formed in the most downstream station exists in the pixel of interest. In the present embodiment, the most downstream station is the fourth station SK, and therefore, black for which an image is formed in the station exists in the pixel of interest (whether the density value of K is 1 or more) is determined. In the case where black exists in the pixel of interest, the processing proceeds to step 905. On the other hand, in the case where black does not exist in the pixel of interest, the processing proceeds to step 906.

At step 905, the ghost determination unit 403 determines whether or not the toner amount of a color in the corresponding pixel, for which an image is formed in the station other than the most downstream station, exceeds a predetermined value (here, "140%"). In the present embodiment, whether the total sum of the density values of yellow, magenta, and cyan in the pixel located at the position a distance corresponding to the perimeter of the photoconductor drum above the pixel of interest exceeds a predetermined value is determined. The reason the predetermined value as the determination criterion is set to "140%" is that in the present embodiment in which Vth is set to −300 V, as described above, in the case where the toner amount of the upstream toner image data is equal to or more than 140%, the surface potential after the primary transfer exceeds the absolute value Vth and due to the image formation in the upstream station, the surface potential of the photoconductor drum of the downstream station becomes uneven also after electrification. In the present embodiment, what affects the image data of black for which an image is formed in the fourth station SK is the image data of yellow, magenta, and cyan for which images are formed in the first to third stations, and therefore, determination is performed as to the total toner amount of these three colors. In the case where the results of the determination indicate that the total sum of the density values of yellow, magenta, and cyan in the corresponding pixel exceeds the predetermined value, the processing proceeds to step 908. On the other hand, in the case where the total sum of the density values of yellow, magenta, and cyan in the corresponding pixel does not exceed the predetermined value, the processing proceeds to step 906.

At step 906, the ghost determination unit 403 determines whether or not the color for which an image is formed in the station one before the most downstream station exists in the pixel of interest. In the present embodiment, the station one before the most downstream station is the third station SC, and therefore, whether or not cyan for which an image is formed in the station exists in the pixel of interest (whether the density value of C is 1 or more) is determined. In the case where cyan exists in the pixel of interest, the processing proceeds to step 907. On the other hand, in the case where cyan does not exist in the pixel of interest, the processing proceeds to step 909.

At step 907, the ghost determination unit 403 determines whether or not the toner amount of the colors for which images are formed in the upstream stations located on the upstream side of the station one before the most downstream station exceeds the above-described predetermined value (1400). In the present embodiment, whether the total sum of the density values of yellow and magenta in the pixel located a distance corresponding to the perimeter of the photoconductor drum above the pixel of interest exceeds the predetermined value is determined. In other words, what affects the image data of cyan for which an image is formed in the third station is yellow and magenta for which images are formed in the first and second stations, and therefore, determination is performed as to the total of these two colors. In the case where the results of the determination indicate that total sum of the density values of yellow and magenta in the corresponding pixel exceeds the predetermined value, the processing proceeds to step 908. On the other hand, in the case where the total sum of the density values of yellow and magenta in the corresponding pixel does not exceed the predetermined value, the processing proceeds to step 909.

At step 908, the ghost determination unit 403 determines the pixel of interest to be a pixel having a strong possibility of the occurrence of a ghost.

At step 909, the ghost determination unit 403 determines whether the processing has been completed for all the pixels within the color image data to be printed. In the case where there is a pixel on which the processing has not been performed yet, the processing proceeds to step 910, and the pixel of interest is updated to the next pixel and the processing at step 903 and subsequent steps is repeated. On the other hand, in the case where the processing has been completed for all the pixels within the color image data to be printed, the present processing is terminated.

The above is the contents of the ghost determination processing. The results of the ghost determination processing are input to the toner amount adjustment unit 404.

In the flow shown in FIG. 9, determination is performed for each pixel. However, a ghost occurs in an image area having a certain area. Consequently, it may also be possible to perform determination for each block of an arbitrary size (e.g., 4×4 pixels or 8×8 pixels).

Further, the flow shown in FIG. 9 premises the engine of a four-color four-drum tandem system including four stations put side by side in the order of Y, M, C, and K from the upstream side. It is needless to say that the contents of the flow change depend on the configuration of the engine. For example, in the case of the engine of a six-color six-drum tandem system including six stations, i.e., pale toner stations, such as a light cyan station and a light magenta station, being added, the number of determination steps corresponding to step 904 and step 906 described above increases by two as a result.

<About Toner Amount Adjustment Unit>

Next, the toner amount adjustment processing in the toner amount adjustment unit 404, which is performed based on the determination results by the ghost determination unit 403, is explained. As described above, in the case where it is determined that a predetermined or larger number of pixels having a possibility of the occurrence of a ghost are included within the image data to be printed by the ghost determination unit 403, the toner amount adjustment unit 404 performs processing to adjust the toner amount of the upstream toner image data. In the case of the present embodiment, the adjustment is made so that the maximum toner amount of the whole of the image data to be printed is "140%".

Figure 10:
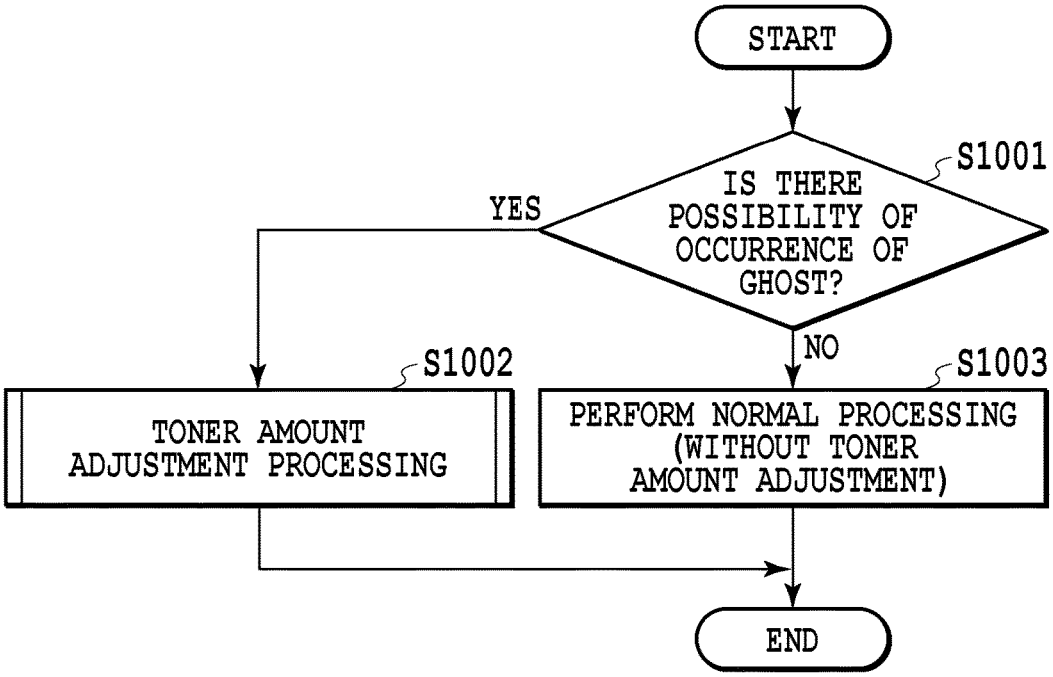
FIG. 10 is a flowchart of pre-processing to determine whether to perform toner amount adjustment processing.

FIG. 10 is a flowchart of pre-processing to determine whether or not to perform the toner amount adjustment processing in the toner amount adjustment unit 404.

At step 1001, the toner amount adjustment unit 404 determines whether or not there is a possibility of the occurrence of a ghost in the image data to be printed based on the determination results received from the ghost determination unit 403 (or whether or not the possibility of the occurrence of a ghost is strong). This determination processing can also be said as processing to determine whether or not toner amount adjustment is necessary, and specifically, it is determined that the image data has a possibility of the occurrence of a ghost (that toner amount adjustment is necessary) in the case where the number of pixels determined to be pixels having a possibility of the occurrence of a ghost at step 908 of the ghost determination processing described previously is equal to or more than a predetermined number of pixels. In this case, the predetermined number of pixels is an arbitrary number, for example, ten, and is appropriately determined in accordance with the size of the image data, the image quality required for an output image, the characteristics of the printer engine, etc. In the case where the previously described ghost determination processing is performed for each block of a predetermined size, the above-described "equal to or more than a predetermined number of pixels" is read as "equal to or more than a predetermined number of blocks".

In the case where the results of the determination indicate that there is a possibility of the occurrence of a ghost in the image data to be printed (the possibility is strong), the processing proceeds to step 1002 and the toner amount adjustment processing (processing to reduce the maximum toner amount), to be described later, is performed.

On the other hand, in the case where it is determined that there is not a possibility of the occurrence of a ghost in the image data to be printed (the possibility is faint), the processing proceeds to step 1003 and the input image data is output as it is without performing the toner amount adjustment processing.

<Toner Amount Adjustment Processing>

Figure 11:
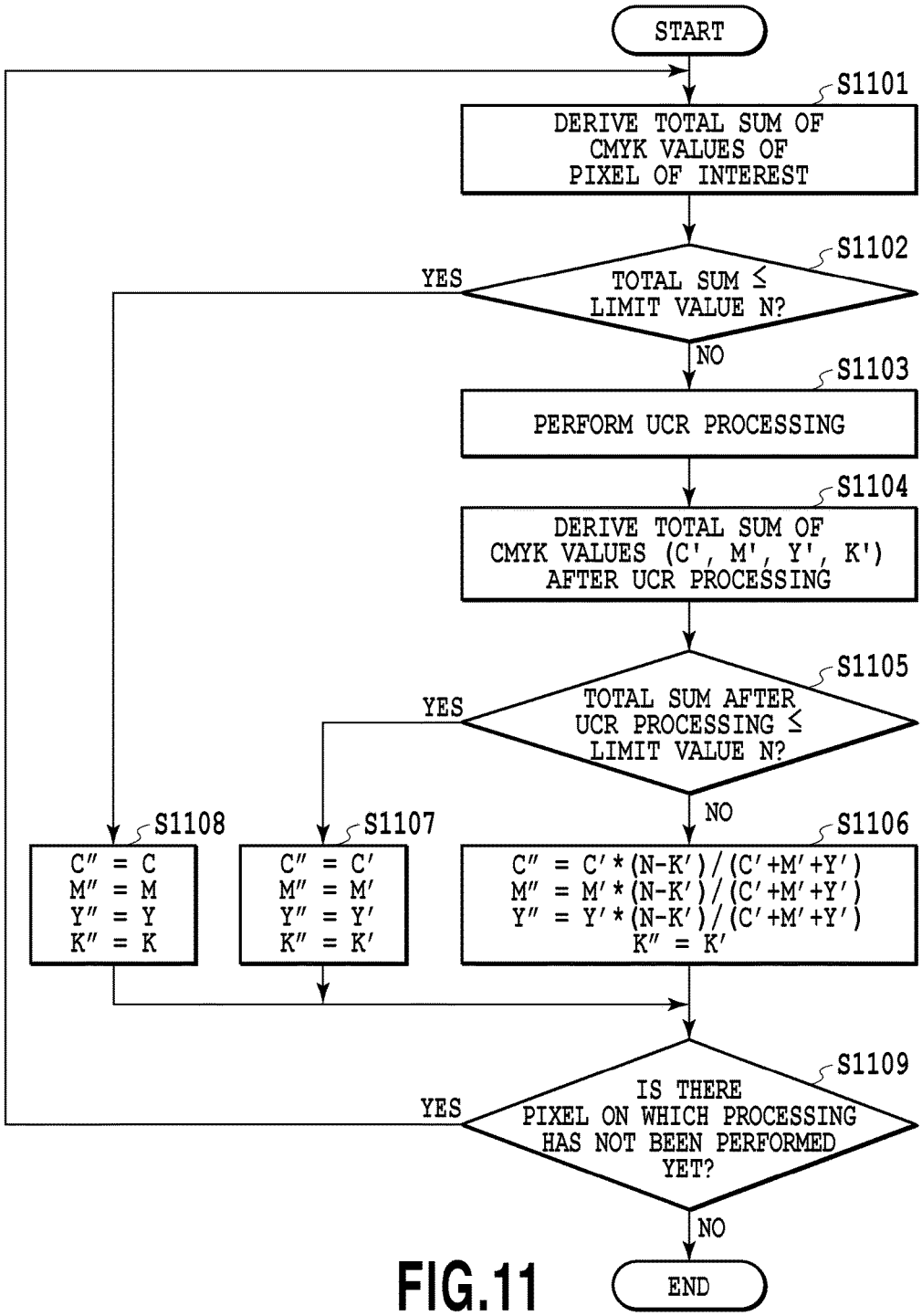
FIG. 11 is a flowchart showing a flow of toner amount adjustment processing.

Subsequently, details of the toner amount adjustment processing are explained. FIG. 11 is a flowchart showing a flow of the toner amount adjustment processing.

At step 1101, the toner amount adjustment unit 404 finds a total sum SUM of CMYK values for the pixel of interest within the input image data (CMYK image data) that is the target of processing.

At step 1102, the toner amount adjustment unit 404 compares the derived total sum SUM of CMYK values with a predetermined limit value N and determines whether the value of the total sum SUM is equal to or less than the limit value N. Here, the limit value N is 255×140%="357" in the case of the present embodiment where the adjustment is made so that the maximum toner amount of the whole of the image data to be printed is "140%". In the case where the results of the determination indicate that the value of the total sum SUM is equal to or less than the limit value N, the processing proceeds to step 1108. On the other hand, in the case where the value of the total sum SUM is greater than the limit value N, the processing proceeds to step 1103.

At step 1103, the toner amount adjustment unit 404 performs common UCR (Under Color Removal) processing. Specifically, the following processing is performed on the pixel of interest.

First, the minimum value of the value half the value (SUM−N), which is the value by which the total sum SUM of the CMYK values exceeds the limit value N, the value of the C component, the value of the M component, and the value of the Y component is taken to be a UCR value. The calculation in which (SUM−N) is divided by 2 at the time of finding the above-described "value half (SUM−N)" is implemented by, for example, the right shifting of one bit.

Next, the smaller value of the maximum value that the value of the K component can take (255 in the case of the present embodiment) and the original value of the K component to which the above-described UCR value has been added is taken to be a value K' of the K component after the UCR processing. In other words, K'=min (255, K+UCR value) is found.

Then, the values obtained by subtracting the difference between the value K' of the K component after the UCR processing that is found and the original value of the K component (i.e., the component on which the UCR processing has been performed) from the original values of C, M, and Y, respectively, are taken to be values C', M', and Y', respectively, of the CMY components after the UCR processing. C', M', and Y' are expressed by expressions as follows.

$$C'=C-(K'-K)$$

$$M'=M-(K'-K)$$

$$Y'=Y-(K'-K)$$

At step 1104, the toner amount adjustment unit 404 derives a total sum SUM' of the values C', M', Y', and K' of the respective new color components obtained by performing the UCR processing.

At step 1105, the toner amount adjustment unit 404 compares the derived total sum SUM' of the C', M', Y', and K' values with the above-described limit value N and determines whether the value of the total sum SUM' after the UCR processing is equal to or less than the limit value N. In the case where the value of the total sum SUM' after the UCR processing is equal to or less than the limit value N, the processing proceeds to step 1107. On the other hand, in the case where the value of the total sum SUM' after the UCR processing is greater than the limit value N, the processing proceeds to step 1106.

At step 1106, the toner amount adjustment unit 404 first determines the value K' of the K component after the UCR processing to be a new output value K" for the pixel of interest. Then, the toner amount adjustment unit 404 divides the value (N−K'), which is obtained by subtracting the value of K" (=value of K') determined to be the output value from the limit value N, in accordance with a ratio of the other color component values C', M', and Y' and determines the respective values that are obtained to be output values C", M", and Y" of the respective color components. In other words, the respective values that are expressed by respective expressions below are found and are taken to be respective new output values for the pixel of interest.

$$C''=C'*(N-K')/(C'+M'+Y')$$

$$M''=M'*(N-K')/(C'+M'+Y')$$

$$Y''=Y'*(N-K')/(C'+M'+Y')$$

$$K''=K'$$

At step 1107, the toner amount adjustment unit 404 determines the respective C', M', Y', and K', which are the respective color component values after the UCR processing, to be the respective new output values C", M", Y", and K" for the pixel of interest.

At step 1108, the toner amount adjustment unit 404 determines the respective color component values C, M, Y, and K in the input image data to be the respective output values C", M", Y", and K" for the pixel of interest.

At step 1109, the toner amount adjustment unit 404 determines whether the processing has been completed for all the pixels of the input image data. In the case where there is a pixel on which the processing has not been performed yet, the processing returns to step 1101, and the processing is repeated by taking the next pixel to be the pixel of interest. On the other hand, in the case where there is not a pixel on which the processing has not been performed yet, the present processing is terminated.

The above is the contents of the toner amount adjustment processing. In the present embodiment, the predetermined limit value at step 1102 is taken to be "140%", which is the same as the determination criterion in the ghost determination processing, but both do not necessarily need to be the same. For example, it may also be possible to take the predetermined limit value in the toner amount adjustment processing to be "160%" while taking the determination criterion in the ghost determination processing to be "140%" and to change the limit value to the smaller limit value in the case where a ghost is not suppressed by checking the state of the occurrence of a ghost in the printing results. Further, the contents of the toner amount adjustment processing shown in the flow in FIG. 11 are merely exemplary and any adjustment may be accepted as long as the toner amount can be adjusted eventually so as to suppress the occurrence of a ghost. By the toner amount adjustment processing such as this, the image data is adjusted so that the surface potential of the photoconductor of the downstream station is not uneven also after electrification, and as a result of this, the occurrence of a ghost is suppressed.

As above, according to the present invention, whether there is a possibility that the image data that is formed on the upstream side in the conveyance direction of a printing medium will affect the image data that is formed on the downstream side is determined and in the case where it is determined that there is a possibility of the influence, the toner amount of the image data is adjusted. At this time, by adjusting the image data (toner amount) that is used for image formation in the upstream station, it is made possible to suppress the occurrence of a ghost more easily.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, it is possible to suppress the occurrence of a ghost both easily and effectively in an image forming apparatus of an electrographic system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-015293, filed Jan. 29, 2015 which is hereby incorporated by reference herein in its entirety.

What is claimed is:

1. An image forming apparatus that forms an image on a printing medium by an electrophotographic system in accordance with input image data, the apparatus comprising:

a plurality of image forming units configured to form images in colors different from one another;

a processor; and a memory storing data, the processor and the memory configured to function as:

a determination unit configured to determine whether or not a number of pixels in which an image defect is expected to occur is equal to or greater than a predetermined number of pixels based on a pixel value of image data that is used for image formation in a second image forming unit located upstream of a first image forming unit, with respect to a conveyance direction of the printing medium, among the plurality of image forming units; and a toner amount adjustment unit configured to make a toner amount adjustment for the image data that is used for image formation in the second image forming unit in a case that the number of pixels in which the image defect is expected to occur is equal to or greater than the predetermined number of pixels as a result of determination by the determination unit.

2. The image forming apparatus according to claim 1, wherein the predetermined number of pixels is determined in accordance with at least one of a size of the input image data, image quality required for an output image, and characteristics of a printer engine.

3. An image forming apparatus that forms an image on a printing medium by an electrophotographic system in accordance with input image data, the apparatus comprising:

a plurality of image forming units configured to form images in colors different from one another;

a processor; and a memory storing data, the processor and the memory configured to function as:

a determination unit configured to determine whether or not a number of blocks consisting of a plurality of pixels in which an image defect is expected to occur is equal to or greater than a predetermined number of blocks based on a pixel value of image data that is used for image formation in a second image forming unit located upstream of a first image forming unit, with respect to a conveyance direction of the printing medium, among the plurality of image forming units; and a toner amount adjustment unit configured to make a toner amount adjustment for the image data that is used for image formation in the second image forming unit in a case that the number of blocks consisting of the plurality of pixels in which the image defect is expected to occur is equal to or greater than the predetermined number of blocks as a result of the determination by the determination unit.

4. The image forming apparatus according to claim 3, wherein the predetermined number of blocks is determined in accordance with at least one of a size of the input image data, image quality required for an output image, and characteristics of a printer engine.

5. An image forming apparatus that forms an image on a printing medium by an electrophotographic system in accordance with input image data, the apparatus comprising:

a plurality of image forming units configured to form images in colors different from one another;

a processor; and a memory storing data, the processor and the memory configured to function as:

a first determination unit configured to determine whether or not a number of pixels in which an image defect is expected to occur is equal to or greater than a predetermined number of pixels based on a pixel value of image data that is used for image formation in a second image forming unit located upstream of a first image forming unit, with respect to a conveyance direction of the printing medium, among the plurality of image forming units;

a second determination unit configured to determine a presence/absence of a pixel in which the image defect is expected to occur for each pixel on a basis of whether an image that makes uneven a surface potential of a photoconductor drum of the first image forming unit is formed in the second image forming unit in a case that an image is formed in the first image forming unit for the input image data; and a toner amount adjustment unit configured to make a toner amount adjustment for the image data that is used for image formation in the second image forming unit in a case that the number of pixels in which the image defect is expected to occur is equal to or greater than the predetermined number of pixels as a result of the determination by the first determination unit.

6. The image forming apparatus according to claim 5, wherein the second determination unit determines that a pixel of interest is a pixel in which an image defect is expected to occur in a case that a pixel located at a predetermined position in an upward direction of the pixel of interest in the input image data includes a color of an image that is formed in the second image forming unit and on a condition that a toner amount of the color of the image that is formed in the second image forming unit for the pixel located at the predetermined position exceeds a predetermined value.

7. The image forming apparatus according to claim 6, wherein the predetermined value is a toner amount of image data that is used for image formation in the second image forming unit, which will make uneven the surface potential of a photoconductor drum of the first image forming unit also after electrification due to the image formation in the second image forming unit.

8. The image forming apparatus according to claim 6, wherein the predetermined position in the upward direction is a position spaced apart from the pixel of interest by a distance corresponding to the perimeter of a photoconductor drum in a direction in which development was previously performed.

9. The image forming apparatus according to claim 6, wherein the second determination unit does not perform determination that a pixel of interest is a pixel in which an image defect is expected to occur for each pixel in a case that the input image data is monochrome image data.

10. An image forming apparatus that forms an image on a printing medium by an electrophotographic system in accordance with input image data, the apparatus comprising:

a plurality of image forming units configured to form images in colors different from one another;

a processor; and a memory storing data, the processor and the memory configured to function as:

a determination unit configured to determine whether or not a number of pixels in which an image defect is expected to occur is equal to or greater than a predetermined number of pixels based on a pixel value of image data that is used for image formation in a second image forming unit located upstream of a first image forming unit, with respect to a conveyance direction of the printing medium, among the plurality of image forming units; and a toner amount adjustment unit configured to perform processing to reduce a toner amount to an amount equal to or less than a limit value for the image data that is used for image formation in the second image forming unit in a case that the number of pixels in which the image defect is expected to occur is equal to or greater than the predetermined number of pixels as a result of the determination by the determination unit.

11. The image forming apparatus according to claim 10, wherein the second determination unit determines that a pixel of interest is a pixel in which an image defect is expected to occur in a case that a pixel located at a predetermined position in an upward direction of the pixel of interest in the input image data includes a color of an image that is formed in the second image forming unit and on a condition that a toner amount of the color of the image that is formed in the second image forming unit for the pixel located at the predetermined position exceeds a predetermined value, and the limit value is equal to the predetermined value.

12. The image forming apparatus according to claim 10, wherein the second determination unit determines that a pixel of interest is a pixel in which an image defect is expected to occur in a case that a pixel located at a predetermined position in an upward direction of the pixel of interest in the input image data includes a color of an image that is formed in the second image forming unit and on a condition that a toner amount of the color of the image that is formed in the second image forming unit for the pixel located at the predetermined position exceeds a predetermined value, and the toner amount adjustment unit makes adjustment using a second limit value that is lower than a first limit value in accordance with results of adjustment using the first limit value that is higher than the predetermined value.

13. An image forming method in an image forming apparatus that forms an image on a printing medium by an electrophotographic system in accordance with input image data, the method comprising the steps of:

determining whether or not a number of pixels in which an image defect is expected to occur is equal to or greater than a predetermined number of pixels based on a pixel value of image data that is used for image formation in a second image forming unit located upstream of a first image forming unit, with respect to a conveyance direction of the printing medium, among a plurality of image forming units configured to form images in colors different from one another; and making a toner amount adjustment for the image data that is used for image formation in the second image forming unit in a case that the number of pixels in which the image defect is expected to occur is equal to or greater than the predetermined number of pixels as a result of the determination in the determining step.

14. A non-transitory computer readable storage medium storing a program for causing a computer to perform an image forming method in an image forming apparatus that forms an image on a printing medium by an electrophotographic system in accordance with input image data, the method comprising the steps of:

determining whether or not a number of pixels in which an image defect is expected to occur is equal to or greater than a predetermined number of pixels based on a pixel value of image data that is used for image formation in a second image forming unit located upstream of a first image forming unit, with respect to a conveyance direction of the printing medium, among a plurality of image forming units configured to form images in colors different from one another; and making toner amount adjustment for the image data that is used for image formation in the second image forming unit in a case that the number of pixels in which the image defect is expected to occur is equal to or greater than the predetermined number of pixels as a result of the determination in the determining step.

* * * * *